US007389887B2

(12) United States Patent
Liang

(10) Patent No.: US 7,389,887 B2
(45) Date of Patent: Jun. 24, 2008

(54) PORTABLE FOLDABLE SHELF

(76) Inventor: Lin Liang, Song Shan Industry Sha Jing Town Baoan, Shenzhen (CN)

( * ) Notice: Subject to any disclaimer, the term of this patent is extended or adjusted under 35 U.S.C. 154(b) by 199 days.

(21) Appl. No.: 11/192,856

(22) Filed: Jul. 28, 2005

(65) Prior Publication Data

US 2006/0226101 A1 Oct. 12, 2006

(30) Foreign Application Priority Data

Apr. 5, 2005 (CN) ..... 2005 2 0056815 U

(51) Int. Cl.
*A47F 5/08* (2006.01)

(52) U.S. Cl. ..... 211/149; 211/201

(58) Field of Classification Search ..... 211/149, 211/201, 126.6, 132.1, 195, 194, 188; 248/166, 248/150; 108/162, 163, 166, 167, 170, 171, 108/175; 403/53, 54, 389, 391, 396; 16/365, 16/373, 366

See application file for complete search history.

(56) References Cited

U.S. PATENT DOCUMENTS

| | | | | | |
|---|---|---|---|---|---|
| 1,198,431 | A * | 9/1916 | Forsyth | 108/163 |
| 2,938,632 | A * | 5/1960 | Mondineu | 108/106 |
| 3,093,247 | A * | 6/1963 | Erickson | 108/188 |
| 3,656,439 | A * | 4/1972 | Domin | 108/175 |
| D280,491 | S * | 9/1985 | Nielsen | D9/432 |
| 4,878,682 | A * | 11/1989 | Lee | 280/42 |
| 5,042,198 | A * | 8/1991 | Privratsky | 49/248 |
| 5,131,547 | A * | 7/1992 | Goldberg | 211/149 |
| 6,123,207 | A * | 9/2000 | Mast | 211/149 |
| 6,213,494 | B1 * | 4/2001 | Liaw | 280/651 |
| 6,260,488 | B1 * | 7/2001 | Yang et al. | 108/107 |
| 6,325,224 | B1 * | 12/2001 | Brown | 211/194 |

* cited by examiner

*Primary Examiner*—Jennifer E. Novosad
(74) *Attorney, Agent, or Firm*—Raymond Y. Chan; David and Raymond Patent Firm

(57) ABSTRACT

The present invention discloses a portable shelf including a pair of shelf plates each having two folding members pivotally connected with each other by inner edges, a pair of side frames pivotally connecting the two plates to form a rectangular body, and a folding arrangement including two connecting guiders spacedly extended from the inner edges of the upper folding member to the inner edges of the lower folding member, and two reinforcement sliders which are pivotally coupled with the bottom frame and slidably mounted along the connecting guiders respectively, adapted to fold the foldable shelf between an unfolded position and a folded position.

11 Claims, 4 Drawing Sheets

PORTABLE FOLDABLE SHELF

BACKGROUND OF THE PRESENT INVENTION

1. Field of Invention

The present invention relates to stuff shelves, and more particularly, to a foldable stuff shelf which is able to be folded for convenient portability and easy storage.

2. Description of Related Arts

Stuff shelves have been widely used in routing practices for disposing goods. For example, stuff shelves could be disposed in a room for placing the books or a variety of household utensils. Or otherwise, stuff shelves could be employed for disposing stuffs not suitable to be laid onto the floors in outdoor activities. Commonly, most stuff shelves available on the market are of fixed structure, which includes a rectangular frame and a plurality of panels spacedly supported by the rectangular frame. Such kind of stuff shelf having comparably simple structure is light weight and user friendly practicality, and it is welcomed by household families, individuals as well as students living in dormitories. However, there are still some drawbacks of such stuff shelves emerged in practices. First of all, this kind of stuff shelves would more or less occupy certain space for storage. Moreover, such kind of stuff shelves could not be disposed into a trunk of a vehicle thus restraining its utilization in outdoor activities.

Detachable stuff shelves need time and effort to assemble and disassemble although it can save spaces for storage and transportation. However, such detachable stuff shelves are unexceptionally made of large numbers of assembling parts and connecting means. The likelihood of such parts or connecting means to be lost during transportations and operations is rather high. Needless to say, the loss of key parts of the detachable stuff shelves would impose a serious headache to the user, especially under a dark and outdoor circumstance.

SUMMARY OF THE PRESENT INVENTION

A primary object of the present invention is to provide a portable foldable shelf, which is compact in size, easy to fold, convenient to store, wherein two or more such kind of foldable shelves could be stacked up in a securable manner.

Another object of the present invention is to provide a portable foldable shelf, which is able to be folded into a minimized size without disassembling any components and parts of the shelf. Therefore, the portable foldable shelf could be embodied as an overall foldable structure, wherein the folding and unfolding operation would be conveniently achieved without resorting to detachable elements.

Another object of the present invention is to provide a portable foldable shelf, which is able to be lay out with a handy manner for extending the minimized shelf from a folding condition into an instantly serviceable condition.

Accordingly, to achieve the above mentioned object, the present invention provides a foldable shelf, comprising:

an upper shelf frame comprising two upper folding members having two inner edges pivotally connected with each other;

a lower shelf frame comprising two lower folding members having two inner edges pivotally connected with each other;

a pair of side frames pivotally connecting said upper and lower shelf frames to a form rectangular body structure; and a folding arrangement disposed between the upper shelf frame and the lower shelf frame for folding the foldable shelf between an unfolded position and a folded position, wherein at the unfolded position, the top and bottom folding members are extended across the two side frames in a rigid manner so as to form the portable shelf into a rectangular body, wherein at the folded position, the top and bottom folding members are pivotally overlapped to minimize a distance between the two side frames so as to fold up the foldable shelf in a compact manner.

Furthermore, each of the folding members of the upper shelf plate has a recessed portion defined at the inner edge of such folding members, so that when two folding members are hinged together, two recessed portions of the upper folding members will form a top opening on the upper shelf plate for user's maneuverability to lift up the inner edges of upper folding members.

Moreover, each of the side frames comprises two snap footings provided at the a bottom end so that one or more such portable shelves could be stacked together by inserting such snap footings of one foldable shelf into another foldable shelf so as to form a multilayer shelf.

Accordingly, the portable foldable shelf of the present invention has a simple structure and rational design, wherein the hinge structures are exquisitely and subtly applied into all coupling portion of the portable shelf, thus enabling the upper shelf plate, the lower shelf plate, and two side frames overlappedly folded to reduce the overall size of such portable shelf. On the other hand, the hinge structure ensures the portable shelf unfolded in a convenient manner and automatically stands in a stable manner. This is due to the fact that two reinforcement ribs and the connecting guiders of the folding arrangement would further retain the upper shelf plate and the lower shelf plate spacedly mounted to the side frame within a secure and parallel manner. What is more, the upper shelf plate has an opening defined thereon, wherein by inserting a hand into such opening, a user is able to easily maneuver the folding and unfolding operation of such portable foldable shelf. After a user applied a lifting force through the opening, two folding members of the upper and lower shelf plate are adapted be overlapped so as to reduce as well as minimize the distance between two side frames. As a result, the two side frames and the folded upper and lower shelf plates are capable of overlapping together thus significantly minimizing the size of the portable foldable shelf and facilitating the storage and transportation functions. Finally, the snap footings defined on the side frames enable one or more such portable shelves stacked together to form a multilayer shelf with a stable manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
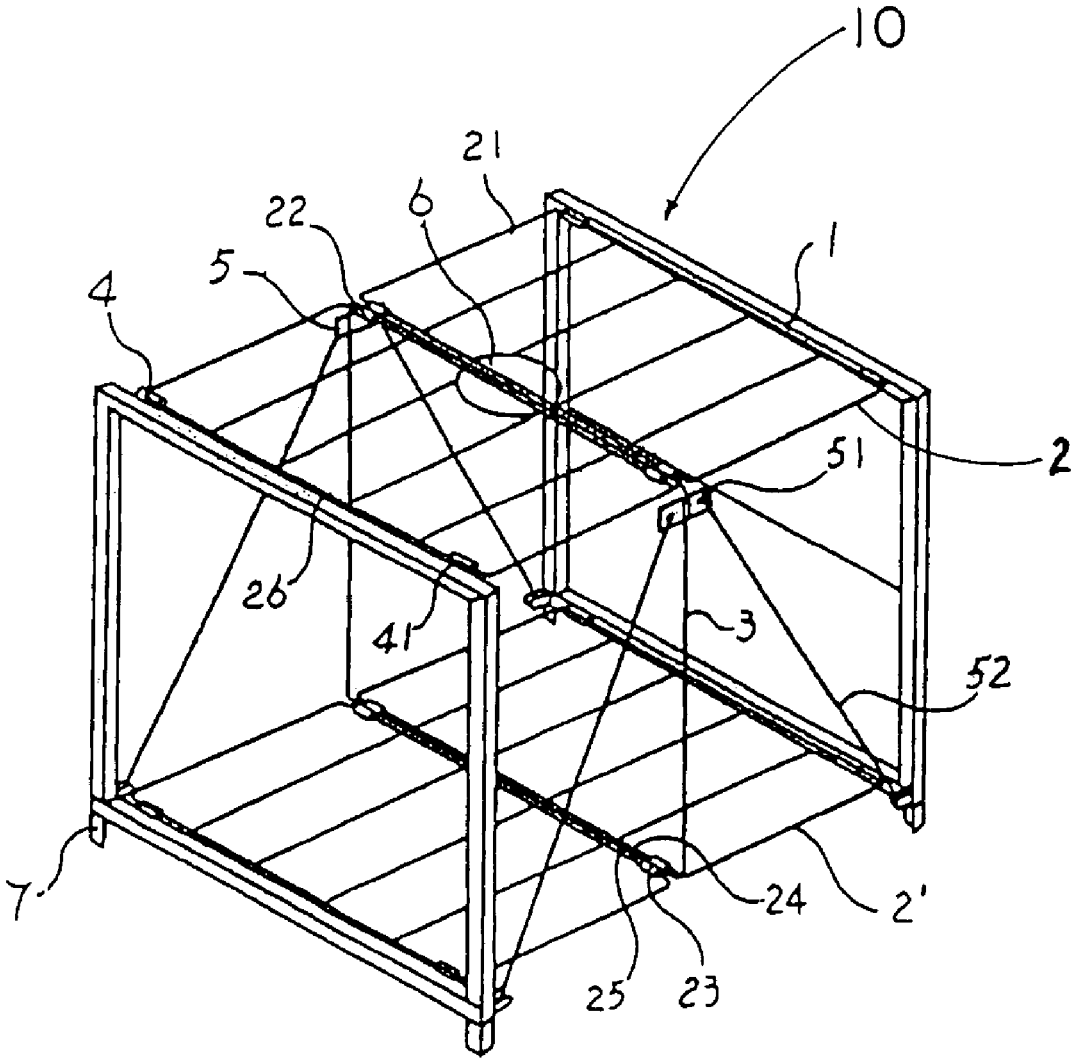
FIG. 1 is a perspective view of a foldable shelf according to the preferred embodiment of the present invention.
Figure 3:
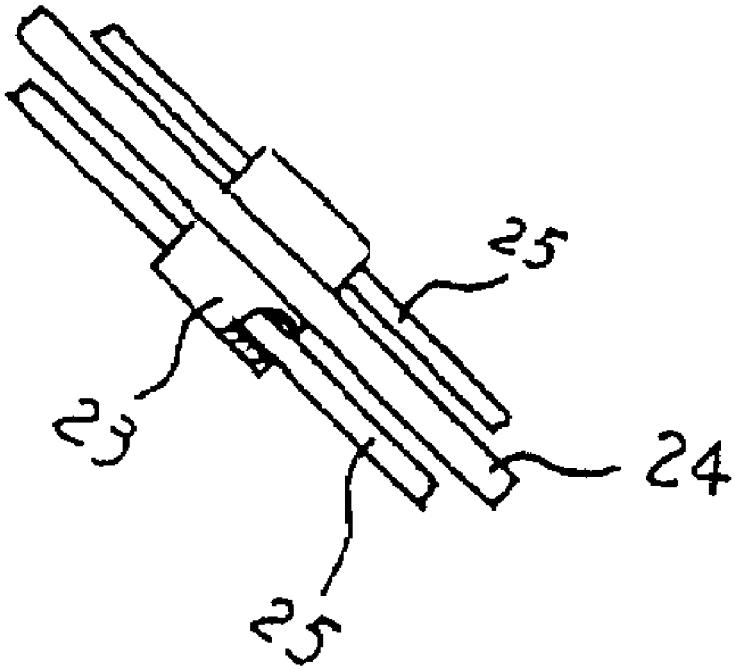
FIG. 3 is a partially top view of the portable foldable shelf according to the preferred embodiment of the present invention showing a pivot joint for coupling two folding members of the upper shelf plate.

Referring to FIG. 1, the portable shelf according to the preferred embodiment of the present invention is illustrated. The foldable shelf 10 comprises a pair of opposing side frame 1, two shelf plates, namely an upper shelf plate 2 and a lower shelf plate 2', pivotally connected to the two side frames 1 for spacedly spanning across onto the two side frames 1 to define a rectangular body, wherein each of the shelf plates comprises a pair of folding member 21, and a pivot joint 22 for pivotally connecting the inner edges of the two folding members 21. Here, the inner edge of the folding member 21 is defined as an inner side arm 25, and the pivot joint 22 comprises two sleeves 23 moveably coupled to the respective side arm 25 of the folding member 21 and a joint shaft 24 integrally extended between the two sleeves 23 for coupling the two sleeves 23 together, such that two folding member 21 could be pivotally folded to overlap together via the pivot joint 22 as shown in FIG. 3.

In other words, the foldable shelf 10 comprises an upper shelf frame 2 comprising two upper folding members 21 having two inner edges pivotally connected with each other, and a lower shelf frame 2' which has an identical structure with the upper shelf frame 2. Accordingly, the lower shelf plate 2' comprises two lower folding members 21' having two inner edges pivotally connected with each other. The foldable shelf 10 further comprises a pair of side frames 1 pivotally connecting the upper and lower shelf frames 2, 2' to a form rectangular body structure.

The joint shaft 24 of the upper shelf plate 2 and the lower shelf plate 2' are interconnected by a pair of spacedly disposed connecting guiders 3, so that the two shelf plates could be moved in a coordinated manner by vertically shifting the connecting guider 3. Each of the upper and lower shelf plates 2, 2' has an outer side arm 26 hinged onto the side frame 1 via a joint member 4, wherein the joint member 4 comprises a sleeve 41 integrally extended from the side frame 1 and moveably mounted to the outer side arm 26. The foldable shelf 10 further comprises two reinforcement sliders 5 for further strengthening the overall structure of the foldable shelf 10, wherein each of the reinforcement slider 5 comprises a sliding bush 51 moveably sleeved onto the guider 3, and a pair of reinforcement ribs 52 each having a lower end hinged to the side frame 1, and an upper end coupled to the sliding bush 51. There is a top opening 6 defined at two sides of the pivot joint 22 of the upper folding member 21 in which a user is able to insert a hand to maneuver the operation of such foldable shelf. Here, it is noted that the upper and lower folding member 21, 21' are defined as perforated or grid shaped for a weight saving purpose and an easier see-through function.

In other words, the portable foldable shelf of the present invention further comprises a folding arrangement comprising two connecting guiders spacedly extended from the inner edges of the upper folding members 21 to the inner edges of the lower folding members 21', and two reinforcement sliders 5 which are pivotally coupled with the two side frames 1 and slidably mount along the connecting guiders 3 respectively, adapted to fold the portable shelf 10 in a folded position and stabilize the portable shelf 10 in an unfolded position.

Here, each of the reinforcement sliders 5 comprises a sliding bush 51 slidably mount onto the connecting guider 3 and a pair of reinforcement ribs 52 each having a lower end pivotally coupled to the two side frames 1 respectively, and an upper end pivotally coupled to the sliding bush 51, wherein at said unfolded position, the sliding bushes are upwardly slid towards the top pivotal joint 22 along the connecting guider 3 until the top and bottom folding members 21, 21' are fully extended across the side frames 1 in a rigid manner, at the folded position, the sliding bushes 51 are downwardly slid towards the bottom pivot joint 22' along the connecting guider 3 allowing the two side frames 1 inwardly approached with each other. That is to say, the reinforcement ribs 52 and the bottom folding members 21 of the lower shelf plate 2 would form a triangle shaped structure for retaining the portable shelf 10 in a stable manner. At the folded position, the sliding bush 51 and the reinforcement ribs 52 are downwardly slid such that the top and bottom folding members 21 are pivotally overlapped to minimize a distance between the two side frames 1 so as to fold up the portable foldable shelf 10 in a compact manner.

Figure 4:
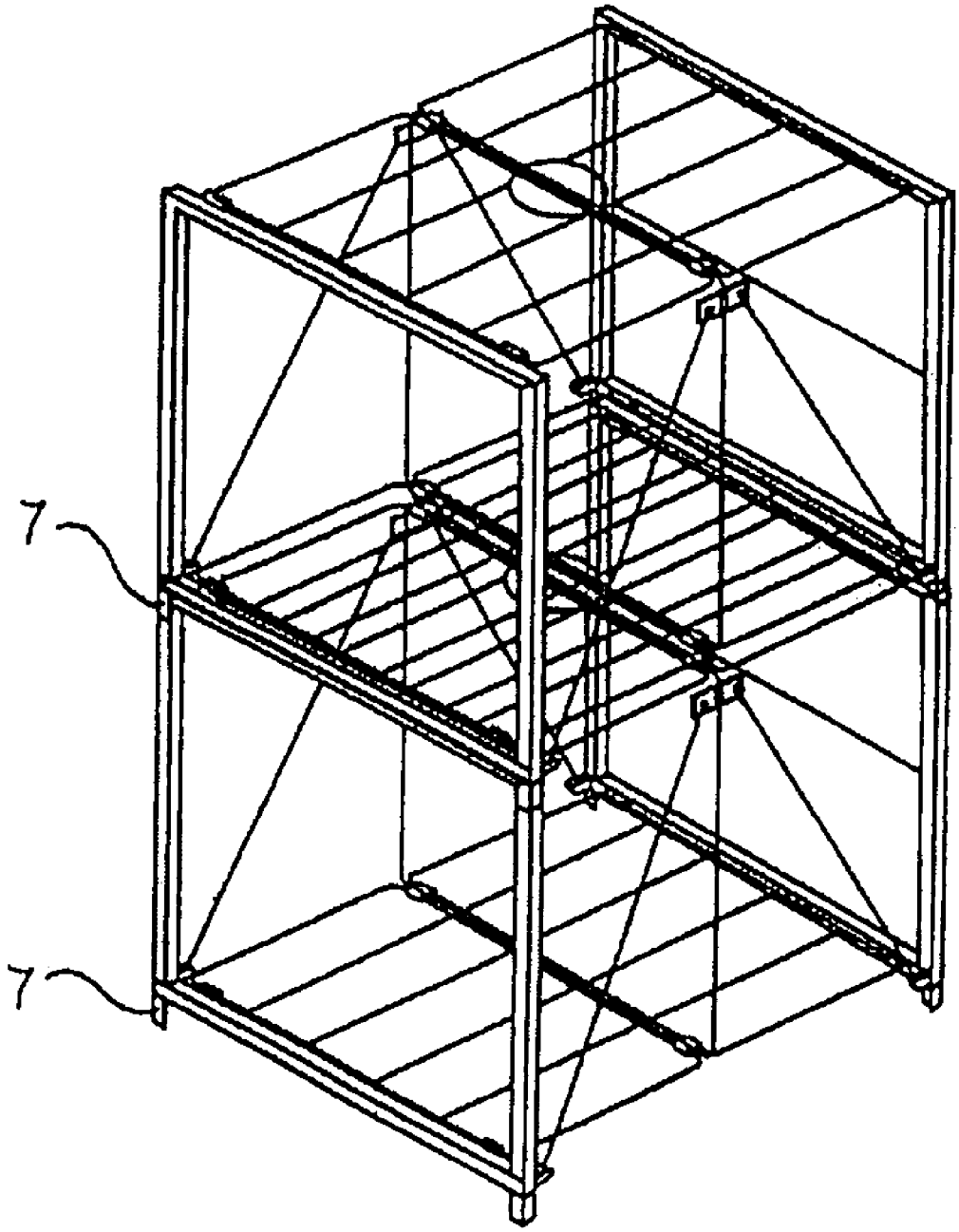
FIG. 4 is a perspective view according to the above preferred embodiment of the present invention showing two identical foldable shelves stacked together.

According to the preferred embodiment of the present invention, the foldable shelf 10 comprises a plurality of snap footings 7 provided at respective bottom end of the side frame 1. Preferably, the snap footings 7 are angularly shaped with four corners as shown in FIG. 1, as a result, once the portable shelf 10 is stacked up, the snap footings 7 are automatically and downwardly projected from the portable shelf not only functioned as footing for ensuring a stable standing, but also for downwardly snapping onto another portable shelf of identical structure so as to generate a multi-layer shelf structure as shown in FIG. 4.

Figure 2:
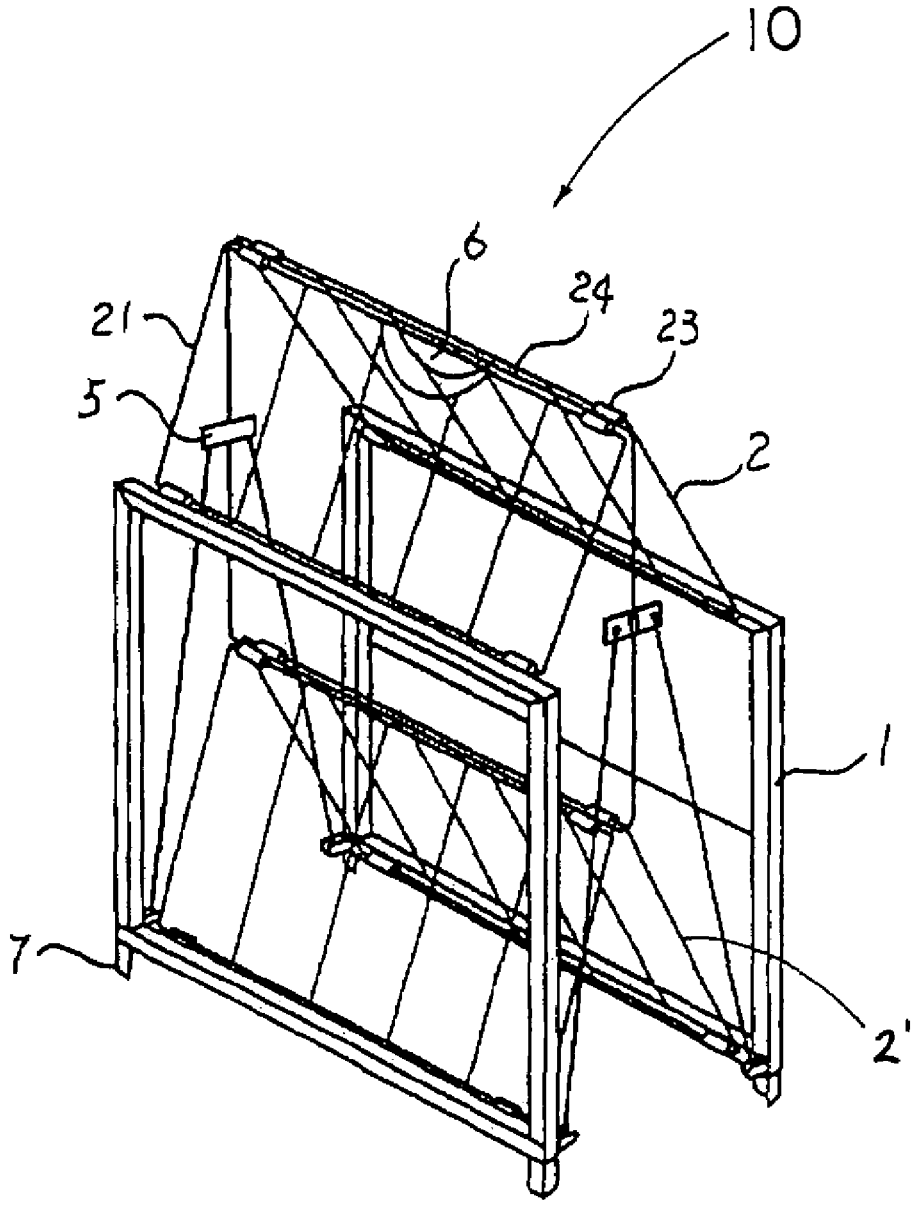
FIG. 2 is a perspective view of the foldable shelf according to the preferred embodiment of the present invention showing the foldable shelf is folded for storage or transportation function.

It is noted that during a practice, the overlappedly hinged shelf plates are adapted to be unfolded by its gravitational force and be interlocked by the connecting guider 3 to form a secure structure. For portability, a user merely inserts his hand into the top opening 6 to upwardly pull the upper folding member 21, the upper shelf plate 2 would be overlappedly and pivotally folded so as to allow two side frames 1 inwardly approach with each other as shown in FIG. 2. Accordingly, the size of the portable shelf 10 is minimized for easier storage and portability.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A foldable shelf, comprising:

an upper shelf frame comprising a plurality of elongated upper folding members each having an inner edge pivotally connected with each other in such a manner that said upper folding members are able to be folded to an overlapped condition and to be unfolded to a planar condition;

a lower shelf frame comprising a plurality of elongated lower folding members each having an inner edge pivotally connected with each other in such a manner that said lower folding members are able to be folded to an overlapped condition and to be unfolded to a planar condition;

two side frames each having an upper portion pivotally connected with said upper shelf frame and a lower portion pivotally connected with said lower shelf frame to form a rectangular frame structure by said upper shelf frame, said lower shelf frame and said two side frames, wherein each of said side frames comprises a plurality of joint members provided on said upper portion and said lower portion respectively for pivotally connecting with said respective upper and said lower folding members; and a folding arrangement operatively provided between said upper shelf frame and said lower shelf frame to operate said foldable shelf to move between a folded position and an unfolded position, wherein at said unfolded position, said upper and said lower folding members are pivotally downwardly unfolded and extended to said planar condition about said corresponding joint members in which said upper and said lower folding members are substantially supported and extended across said two side frames in a secure manner, wherein at said folded position, said upper and lower folding members are pivotally and upwardly folded about said corresponding joint members to overlap with each other to minimize a distance between said two side frames so as to fold up said foldable shelf into a compact size, wherein said folding arrangement comprises two connecting guiders spacedly extended between said upper shelf frame and said lower shelf frame for vertically shifting said upper shelf frame and said lower shelf frame between said folded condition and said unfolded condition in a coordinated manner, wherein a height of each of said connecting guiders is substantially equal to a vertical distance between said upper shelf frame and said lower shelf frame so as to minimize an overall size of said foldable shelf, wherein said folding arrangement further comprises two reinforcement sliders, each of which is pivotally coupled with said two side frames and slidably mounted along said connecting guiders respectively, adapted to fold said foldable shelf in said foldable position and stabilize said foldable shelf in said unfolded position.

2. The foldable shelf, as recited in claim 1, wherein each of said reinforcement sliders comprises a sliding bush slidably mounted onto said connecting guider and a pair of reinforcement ribs each having a lower end pivotally coupled to said two side frames respectively, and an upper end pivotally coupled to said sliding bush, wherein at said unfolded position, said sliding bushes are upwardly slid towards said upper shelf frame along said connecting guider until said top and bottom folding members are fully extended across said side frames, wherein at said folded position, said sliding bushes are downwardly slid towards said bottom pivot joint along said connecting guider allowing said two side frames inwardly approached with each other.

3. The foldable shelf, as recited in claim 2, wherein each of said upper folding members of said upper shelf frame has a recessed portion at said inner edge, so that when said upper folding members are laterally extended together, said two recessed portions are capable of forming a top opening on said upper shelf frame for a hand to lift up said inner edges of said upper folding members.

4. A foldable shelf, comprising:

an upper shelf frame comprising a plurality of elongated upper folding members each having an inner edge pivotally connected with each other in such a manner that said upper folding members are able to be folded to an overlapped condition and to be unfolded to a planar condition;

a lower shelf frame comprising a plurality of elongated lower folding members each having an inner edge pivotally connected with each other in such a manner that said lower folding members are able to be folded to an overlapped condition and to be unfolded to a planar condition;

two side frames each having an upper portion pivotally connected with said upper shelf frame and a lower portion pivotally connected with said lower shelf frame to form a rectangular frame structure by said upper shelf frame, said lower shelf frame and said side frames, wherein each of said side frames comprises a plurality of joint members provided on said upper portion and said lower portion respectively for pivotally connecting with said respective upper and said lower folding members; and a folding arrangement operatively provided between said upper shelf frame and said lower shelf frame to operate said foldable shelf to move between a folded position and an unfolded position, wherein at said unfolded position, said upper and said lower folding members are pivotally downwardly unfolded and extended to said planar condition about said corresponding joint members in which said upper and said lower folding members are substantially supported and extended across said two side frames in a secure manner, wherein at said folded position, said upper and lower folding members are pivotally and upwardly folded about said corresponding joint members to overlap with each other to minimize a distance between said two side frames so as to fold up said foldable shelf into a compact size, wherein said upper shelf frame further comprises an upper pivot joint pivotally connecting said inner edges of said corresponding upper folding members together, wherein said lower shelf frame further comprises a lower pivot joint pivotally connecting said inner edges of said corresponding lower folding members together, wherein said folding arrangement comprises two connecting guiders spacedly extended between said upper shelf frame and said lower shelf frame for vertically shifting said upper shelf frame and said lower shelf frame between said folded condition and said unfolded condition in a coordinated manner, wherein a height of each of said connecting guiders is substantially equal to a vertical distance between said upper shelf frame and said lower shelf frame so as to minimize an overall size of said foldable shelf, wherein said folding arrangement further comprises two reinforcement sliders, each of which is pivotally coupled with said two side frames and slidably mounted along said connecting guiders respectively, adapted to fold said foldable shelf in said foldable position and stabilize said foldable shelf in said unfolded position.

5. The foldable shelf, as recited in claim 4, wherein each of said reinforcement sliders comprises a sliding bush slidably mounted onto said connecting guider and a pair of reinforcement ribs each having a lower end pivotally coupled to said two side frames respectively, and an upper end pivotally coupled to said sliding bush, wherein at said unfolded position, said sliding bushes are upwardly slid towards said upper shelf frame along said connecting guider until said upper and said lower folding members are fully extended across said two side frames, wherein at said folded position, said sliding bushes are downwardly slid towards said lower shelf frame along said connecting guider so as to allow said two side frames inwardly displaced toward each other for being folding into a compact size.

6. The foldable shelf, as recited in claim 5, wherein each of said upper folding members of said upper shelf frame has a recessed portion at said inner edge, so that when said upper folding members are laterally extended together, said two recessed portions are capable of forming a top opening on said upper shelf frame for a hand to lift up said inner edges of said upper folding members.

7. The foldable shelf, as recited in claim 6, wherein each of said upper and said lower shelf frame comprises an inner side arm for transversely connecting said inner edges of said respective folding members, wherein said upper pivot joints and said lower pivot joints comprises at least two tubular sleeves for receiving said respective inner side arm and moveably coupled to said respective inner edge of said folding members, and a joint shaft integrally extended between said two sleeves for pivotally overlapping said folding members together.

8. The foldable shelf, as recited in claim 7, wherein each of said side frames comprises two snap footings provided at a bottom end so that when one or more foldable shelves are stacked together, said snap footings are capable of snapping onto another said foldable shelf so as to form a multilayer shelf.

9. The foldable shelf, as recited in claim 8, wherein said joint member comprises a joint sleeve integrally extended from said side frame and moveably mounted onto said side arm.

10. The foldable shelf, as recited in claim 5, wherein each of said upper and said lower shelf frames comprises an inner side arm for transversely connecting said inner edges of said respective folding members, wherein said upper pivot joints and said lower pivot joints comprises at least two tubular sleeves for receiving said respective inner side arm and moveably coupled to said respective inner edge of said folding members, and a joint shaft integrally extended between said two sleeves for pivotally overlapping said folding members together.

11. A foldable shelf, comprising:

an upper shelf frame comprising a plurality of elongated upper folding members each having an inner edge pivotally connected with each other in such a manner that said upper folding members are able to be folded to an overlapped condition and to be unfolded to a planar condition;

a lower shelf frame comprising a plurality of elongated lower folding members each having an inner edge pivotally connected with each other in such a manner that said lower folding members are able to be folded to an overlapped condition and to be unfolded to a planar condition;

two side frames each having an upper portion pivotally connected with said upper shelf frame and a lower portion pivotally connected with said lower shelf frame to form a rectangular frame structure by said upper shelf frame, said lower shelf frame and said side frames, wherein each of said side frames comprises a plurality of joint members provided on said upper portion and said lower portion respectively for pivotally connecting with said respective upper and said lower folding members; and a folding arrangement operatively provided between said upper shelf frame and said lower shelf frame to operate said foldable shelf to move between a folded position and an unfolded position, wherein at said unfolded position, said upper and said lower folding members are pivotally downwardly unfolded and extended to said planar condition about said corresponding joint members in which said upper and said lower folding members are substantially supported and extended across said two side frames in a secure manner, wherein at said folded position, said upper and lower folding members are pivotally and upwardly folded about said corresponding joint members to overlap with each other to minimize a distance between said two side frames so as to fold up said foldable shelf into a compact size wherein said upper shelf frame further comprises an upper pivot joint pivotally connecting said inner edges of said corresponding upper folding members together, wherein said lower shelf frame further comprises a lower pivot joint pivotally connecting said inner edges of said corresponding lower folding members together, wherein each of said upper and said lower shelf frames comprises an inner side arm for transversely connecting said inner edges of said respective folding members, wherein said upper pivot joints and said lower pivot joints comprises at least two tubular sleeves for receiving said respective inner side arm and moveably coupled to said respective inner edge of said folding members, and a joint shaft integrally extended between said two sleeves for pivotally overlapping said folding members together.

* * * * *